US007927147B1

(12) United States Patent
Shaw et al.

(10) Patent No.: US 7,927,147 B1
(45) Date of Patent: Apr. 19, 2011

(54) CONNECTOR ASSEMBLY

(75) Inventors: Richard William Shaw, Magnolia, TX (US); Richard R. Geveshausen, Cypress, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 20 days.

(21) Appl. No.: 12/638,042

(22) Filed: Dec. 15, 2009

(51) Int. Cl.
*H01R 13/66* (2006.01)

(52) U.S. Cl. ..... 439/620.13

(58) Field of Classification Search ..... 439/620.1, 439/620.11, 620.09, 620.13, 108, 607.3, 439/607.01, 607.17
See application file for complete search history.

(56) References Cited

U.S. PATENT DOCUMENTS

| | | | | |
|---|---|---|---|---|
| 5,120,258 | A | | 6/1992 | Carlton |
| 5,311,408 | A | | 5/1994 | Ferchau |
| 5,436,803 | A | | 7/1995 | Annis |
| 6,133,652 | A | * | 10/2000 | Timieski ..... 307/91 |
| 6,307,538 | B1 | | 10/2001 | Bacon |
| 6,483,720 | B1 | | 11/2002 | Buffet |
| 6,507,495 | B1 | | 1/2003 | Hailey |
| 6,522,538 | B1 | | 2/2003 | Hviid |
| 6,717,047 | B2 | | 4/2004 | Haselby |
| 6,972,967 | B2 | | 12/2005 | Norte |
| 7,207,104 | B1 | | 4/2007 | Steinfeld |
| 7,211,739 | B1 | | 5/2007 | Brigham |
| 2005/0083649 | A1 | | 4/2005 | Behrens |
| 2005/0202724 | A1 | | 9/2005 | Dove |
| 2006/0152912 | A1 | | 7/2006 | Karrer |
| 2006/0160421 | A1 | | 7/2006 | Dangler |
| 2008/0038959 | A1 | | 2/2008 | Barringer |
| 2008/0083562 | A1 | | 4/2008 | Kuczynski |

* cited by examiner

*Primary Examiner* — Javaid Nasri

(57) ABSTRACT

A connector assembly can include a connector with a ground pin and a case. The case can have an electrically conductive surface. A capacitor is connected to the ground pin. The capacitor is also connected to the electrically conductive surface. The capacitor can be connected between the electrically conductive surface and the ground pin so that the electrically conductive surface and the ground pin are capacitively coupled.

6 Claims, 3 Drawing Sheets

CONNECTOR ASSEMBLY

BACKGROUND

Some desktop computers have front and rear audio (e.g., microphone and headphone) connectors that must be connected internally to the same sound device. The sound device is typically located near the rear audio connector, which means relatively long signal paths are required between the front audio connectors and the sound device. To prevent long signal paths from acting like antennae and generating excessive electro-magnetic interference, the signal paths can be direct-current coupled to chassis ground near the front and rear audio connectors. To limit the injection of audio frequency noise from chassis ground into the audio path, the connections to ground can be via capacitors. This technique is commonly referred to as a "hybrid" ground system.

DETAILED DESCRIPTION

Figure 1:
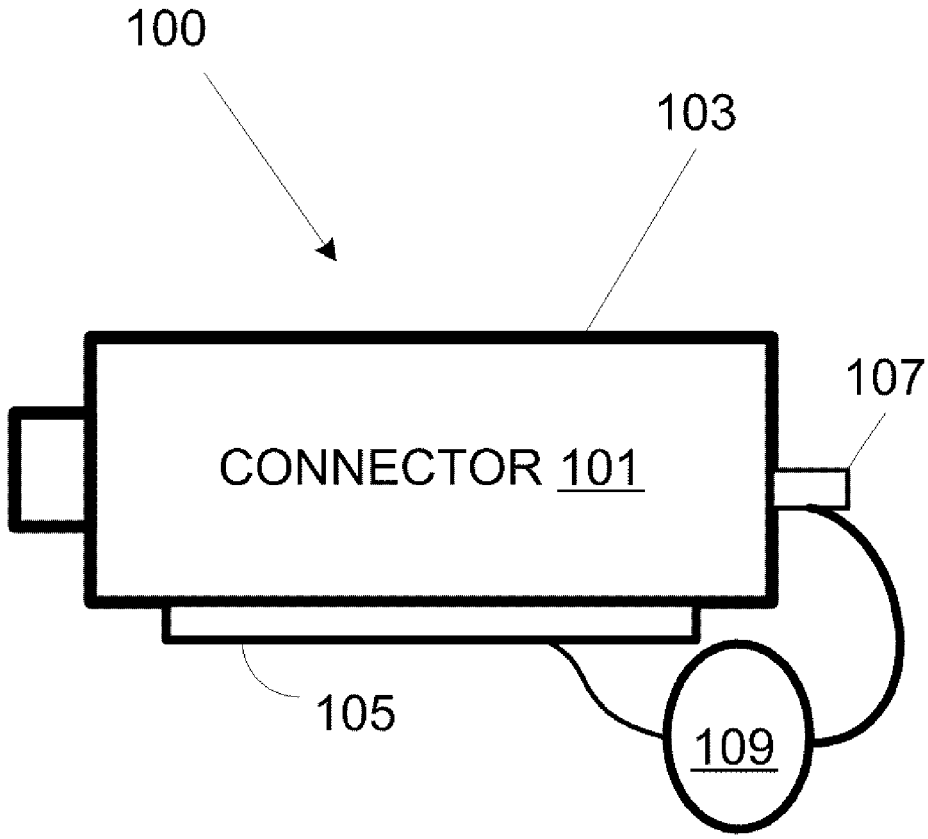
FIG. 1 is a schematic diagram of a connector assembly in accordance with an embodiment.

In accordance with an embodiment, a connector assembly 100 has a connector 101 having case 103 with an electrically conductive surface 105. Herein, a "connector" is a device with at least one element that mates with another element of another device or cable physically and communicatively (e.g., via an electrical connection). The connector also includes a ground pin 107. A capacitor 109 is connected to electrically conductive surface 105 and ground pin 107 so that capacitor 109 is electrically between electrically conductive surface 105 and ground pin 107; thus, electrically conductive surface 105 and ground pin 107 are capacitively coupled so that they are direct-current coupled but isolated at radio frequencies (RF). Herein, two objects are "capacitively coupled" if they are connected via a capacitor, whether or not there is a charge on the capacitor. Compared to systems in which a capacitor is soldered to the connector assembly shell, capacitor leads are shortened so that electro-magnetic interference is reduced. Moreover, assembly is simplified as explained further below.

Figure 2:
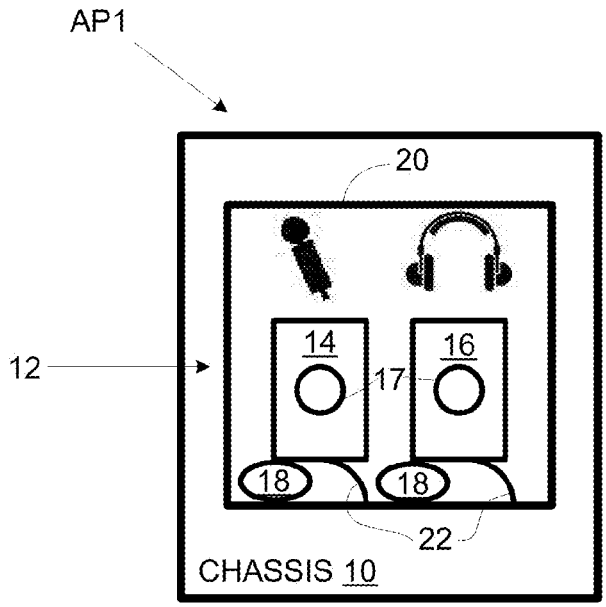
FIG. 2 is a schematic diagram of a computer system with a front-panel audio connector assembly in accordance with an embodiment.

In accordance with an embodiment, a computer system AP1, e.g., a desktop computer or a portable computer, includes a chassis 10 and a front panel audio connector assembly 12 providing for microphone and headphone audio connectors 14 and 16, as shown in FIG. 2. In alternative systems, there can be a single audio connector or more than two audio connectors. In addition, there can be non-audio connectors, including video connectors, USB connectors, and IEEE 1394 connectors instead of or in addition to audio connectors.

Each audio connector 14, 16, has an aperture 17 for receiving an audio plug. In addition, each audio connector has a respective capacitor 18 directly electrically connected to audio ground and to an electrically conductive, e.g., metal, surface of the respective connector. The electrically conductive surface of each audio connector is electrically connected to a metal (or otherwise electrically conductive) shell 20 of assembly 12 via a respective spring 22 of the shell, which, when installed in chassis 10, is held at chassis ground. Thus, audio ground is capacitively coupled to local chassis ground through a capacitor 18 which serves as an RF noise filter for the audio signals associated with the respective audio connector. Herein, "directly electrically connected" implies a low-resistance and low impedance coupling; while "capacitively coupled" implies a low resistance but not a low impedance coupling.

Herein, a "spring" is an element that deforms in response to a force and resumes an original form when that force is removed. Herein, the tendency of a spring to restore its original form is leveraged to ensure good electrical contact. In alternative embodiments, the spring is 1) a separate element, 2) formed on the connector, and 3) formed on the chassis (rather than on the shell), or 4) omitted and a tight fit between the connector and a shell or a chassis is used to ensure good electrical contact.

Figure 3:
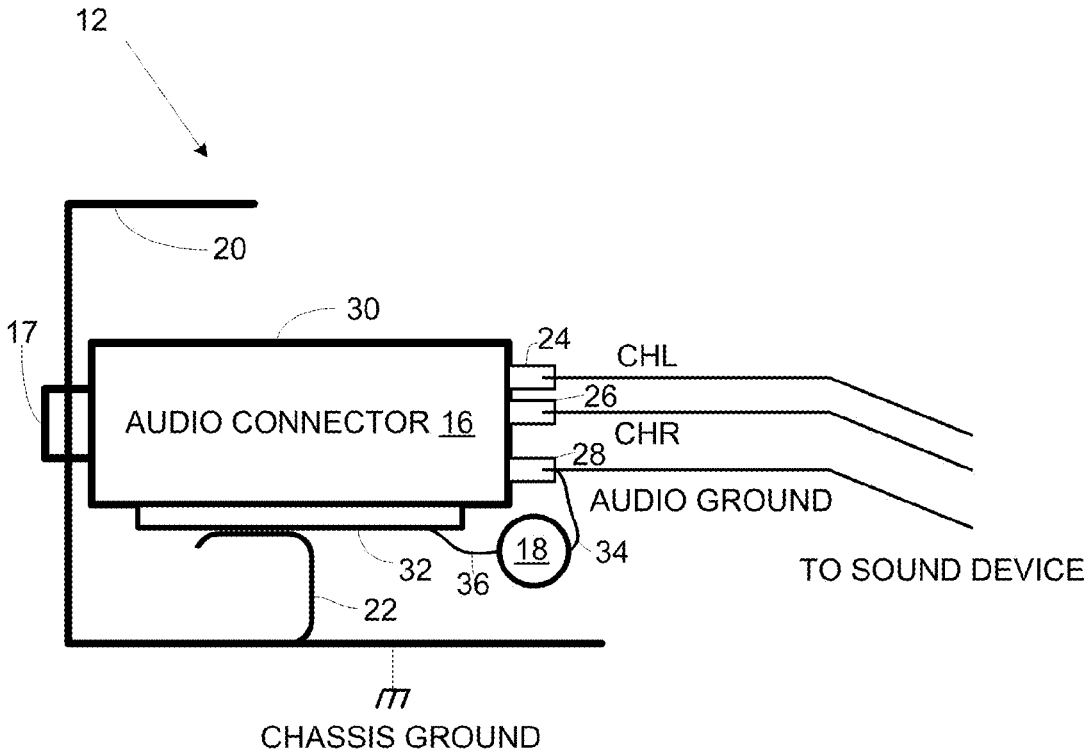
FIG. 3 is a schematic diagram of the front-panel audio connector assembly of the desktop computer of FIG. 1.

As shown in FIG. 3, audio (headphone) connector 16 includes a left-channel signal pin 24, a right channel pin 26, and an audio ground pin 28. Microphone connector 14 (FIG. 2) may contain only one signal pin (unless stereo microphones are provided for), but is in other respects similar to audio connector 16. In one embodiment, Audio connector 16 can have a non-conductive, e.g., plastic, casing 30 on which an electrically conductive pad 32, e.g., metal pad is formed. One lead 34 of capacitor 18 is attached, e.g., soldered, to audio ground pin 28, while another lead 36 of capacitor 18 is soldered to electrically conductive pad 32. Thus, audio ground pin 28 is capacitively coupled to (and thus, direct-current coupled to and radio-frequency isolated from) chassis ground (of chassis 10, FIG. 1) via capacitor 18, pad 32, spring 22, and shell 20.

In an alternative embodiment, the casing of the audio connector is electrically conductive, e.g, metal; in that embodiment, the capacitor and spring connect to the electrically conductive casing rather than to a separate pad. In another embodiment, the capacitor is internal to the audio connector casing. Compared to systems in which a capacitor is soldered to the connector assembly shell, capacitor leads are shortened so that electro-magnetic interference is reduced. Also, assembly is simplified, as explained below with reference to FIG. 4.

Figure 4:
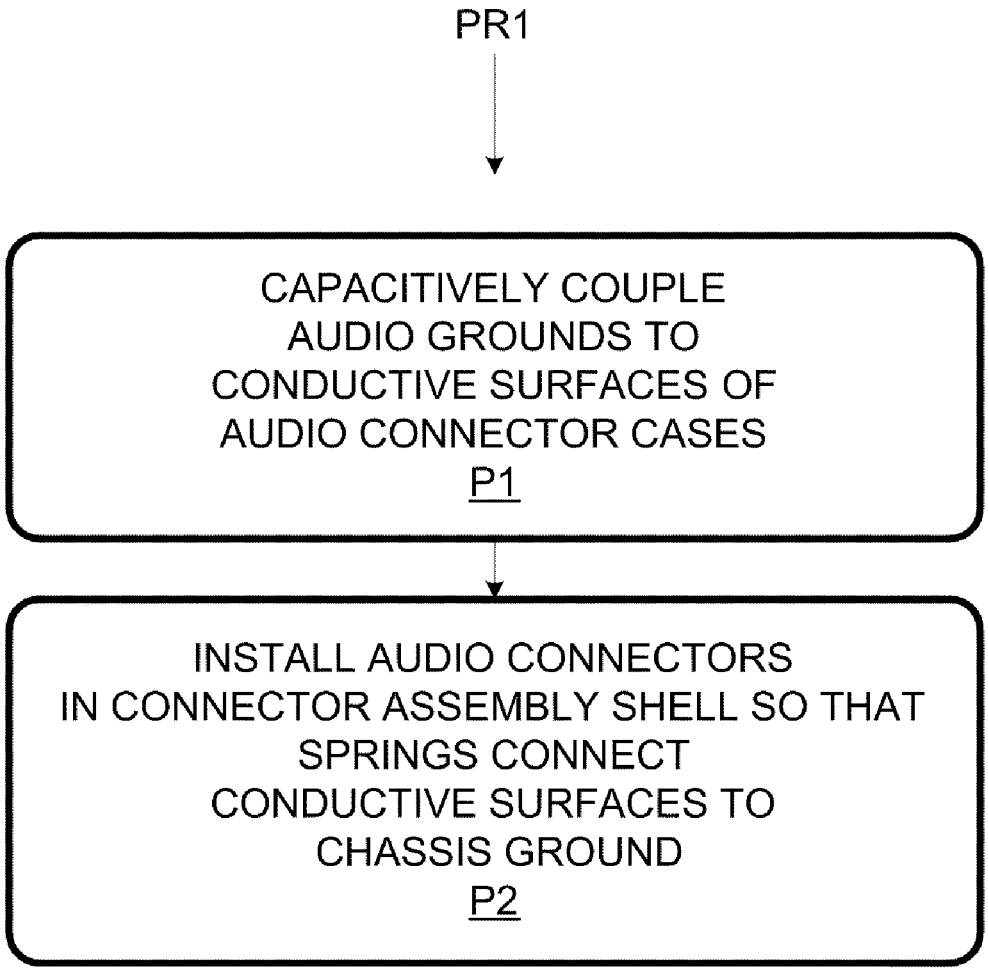
FIG. 4 is a flow chart of a method in accordance with an embodiment for assembly the front-panel audio connector assembly of FIG. 1.

A process PR1 of forming a connector assembly is flow charted in FIG. 4. At process step P1, audio grounds are capacitively coupled to conductive surfaces of respective audio connectors. This can involve soldering capacitor leads to respective audio ground pins and to conductive surfaces to respective audio connector cases. For metal and other electrically conductive cases, the case can serve as the conductive surface; if the case is non-conductive, e.g., plastic, a metal pad can be formed on the cases prior to attaching the capacitors.

Note that since each capacitor connects only to part of a single audio connector, soldering or other attachment process can be completed independently of any assembly of the audio connectors into a connector assembly. This is in contrast to having to solder capacitor leads as the audio connectors are inserted into an assembly shell. Instead, connections to chassis ground are completed by the action of springs as the audio connectors are inserted into the assembly shell at process step P2. Alternatively, a tight fit between the connectors and a shell or chassis can be used to ensure a direct electrical connection.

In this specification, related art is discussed for expository purposes. Related art labeled "prior art", if any, is admitted prior art. Related art not labeled "prior art" is not admitted prior art. The illustrated and other described embodiments, as well as modifications thereto and variations thereupon are within the scope of the following claims.

What is claimed is:

1. A computer system comprising:

a computer chassis defining chassis ground;

a shell for mounting in said chassis so that the shell is directly electrically connected to chassis ground;

a connector including a ground pin and a case having an electrically conductive surface directly electrically connected to said shell; and a capacitor connecting to said ground pin and said electrically conductive surface so that said capacitor is electrically between said ground pin and said electrically conductive surface.

2. A computer system as recited in claim 1 wherein said shell has springs formed thereon that apply a restoring force against said electrically conductive surface to form an electrical contact therewith so that said electrically conductive surface is at chassis ground.

3. A computer system as recited in claim 1 wherein said case is metal and said electrically conductive surface is an external surface said case.

4. A computer system as recited in claim 1 wherein said case is of non-conductive material and said electrically conductive surface is the surface of a metal pad formed on said case.

5. A computer system as recited in claim 1 wherein said connector is a first audio connector, and said ground pin defines audio ground, said first audio connector also including at least one audio signal pin.

6. A computer system as recited in claim 5 further comprising:

a second audio connector having a second audio ground pin and a second electrically conductive surface directly electrically connected to said shell; and a second capacitor connected to said second audio ground pin and said second electrically conductive surface so that said second capacitor is electrically between said second audio ground pin and said second electrically conductive surface.

* * * * *